United States Patent [19]

Yeh et al.

[11] Patent Number: 5,066,308

[45] Date of Patent: Nov. 19, 1991

[54] END IDENTIFIER FOR MULTIDYE YARN

[75] Inventors: Ling Yeh; Hugh G. Harrelson; Andrew M. Coons, III, all of Anderson, S.C.

[73] Assignee: BASF Corporation, Parsippany, N.J.

[21] Appl. No.: 475,599

[22] Filed: Feb. 6, 1990

[51] Int. Cl.[5] ..... D06P 5/13

[52] U.S. Cl. ..... 8/403; 8/539; 8/661; 8/924; 8/147

[58] Field of Search ..... 8/403, 661

[56] References Cited

U.S. PATENT DOCUMENTS 3,891,387 6/1975 Latta et al. ..... 8/403

OTHER PUBLICATIONS

H. Zollinger, "Color Chemistry", (VCH), 1987, pp. 34–39 and 241–243.

Fred W., Billmeyer, Jr. and Max Saltzman, "Principles of Color Technology", 2nd edition, Wiley-Interscience, 1981, pp. 63 and 103.

*Color Index* by American Association of Textile Chemists and Colorists (AATCC), #74160, p. 4618.

*Primary Examiner*—A. Lionel Clingman

*Attorney, Agent, or Firm*—Robert L. Daub; Tom R. Vestal

[57] ABSTRACT

A method of distinguishing two or more variant dye fibers in greige form is disclosed. The technique involves adding sufficient pigment to one of the fibers to make it visible to the eye.

10 Claims, No Drawings

END IDENTIFIER FOR MULTIDYE YARN

BACKGROUND OF THE INVENTION

A common way of manufacturing patterned textile fabrics such as carpeting is through the use of yarns or fibers of various colors. Melt or solution dyed yarns are easily distinguishable in the fabric manufacturing process, as their built-in colors are visible to a process operator. The process operator, then, can positively determine from the pattern design if the correct yarn is being fed to the proper segment of the process. This method is quite satisfactory, but requires a large inventory of yarn for different styles and combinations of colors. The inventory requirement usually results in a limited amount of colors.

Another means of manufacturing fabrics with patterned effects involves printing the pattern after formation of the fabric. This technique is useful for woven or knitted fabrics. Techniques have been developed for printing of tufted fabrics. This latter technique is slow and requires sophisticated machinery.

It is also known to tuft carpet fabrics with greige yarns having different dye affinities to form patterning effects. The difficulty with the use of such yarns is the similarity in their before-dye appearance—the yarns are sufficiently similar in color to create confusion in separating the yarns for patterning during processing.

The industry has heretofore resolved this problem by overspraying each different type of yarn with a fugitive tint. Overspraying is a means by which a fugitive tint in a solvent is applied to the surface of fibers. With four common dye variants—light, deep, cationic, and regular —three must be tinted in order to distinguish the four from each other during simultaneous processing.

The problems encountered with tinting the ends in this method are that the tints are unstable and may migrate during processing to other fibers. Further, the tint may interfere with dyeing if the migration pools the tint in any one locale. Further, deep dye polymers are quite receptive to dyes and often the overspray may become permanently affixed in processing.

THE PRESENT INVENTION

In that the overspray tints have different affinities for the variable dyeing materials, the intent of this invention is to take advantage of the affinity. Nylon containing predominantly amino end groups reacts with acid type dyes. Acid-reacting nylon is referred to as "light", "regular", or "deep" depending on the number (10–70) of amino end groups present. Nylon containing predominately sulphonic end groups is referred to as "cationic" and reacts with basic type dyes. The present invention provides a coloring matrix for forming patterned fabrics from greige yarns comprising imparting a permanent tint to the fiber with the highest dye affinity, leaving the cationic fiber in greige state and overspray tinting the light and regular dye fibers. In this manner, the four ends can be distinguished from each other during the fabric manufacturing process. The fabric can thereafter be scoured to remove the fugitive overspray tint from the light and regular dye fiber and the combination thereafter dyed in a single dyebath. The invention also includes combinations of two, three or four dye variants which include a dark dye fiber end.

DETAILED DESCRIPTION OF THE INVENTION

Utilizing a permanently pigmented tint in the deep dye fiber permits adjustment in the dyebath to achieve a given dye level, as the color level of the original fiber is a known constant. A "deep dye" fiber herein shall mean a polyamide fiber having a high amine end group content; i.e. greater than 60 meq/kg. The original fiber color level can be achieved by either pigment tinting all fibers in the deep dye fiber at a particular low level or blending a deeper pigmented fiber with natural (non-tinted) fibers to obtain the same level of color.

The type and color of the pigment may be varied provided that the pigment is stable under processing conditions. The pigment should also be observable in fabric manufacturing.

EXAMPLE I

Nylon 6 polymer was loaded with pigment, by mixing the pigment either in powder form or with a polyethylene carrier, with the nylon chip just prior to the melt extrusion during the fiber melt spinning operation. The pigment may be in the form of a raw powder or combined with a carrier such as polyethylene. The pigment colors are as follows: phthalo blue (Chemical Index pigment blue 15 number 74160); carbon black (c.i. pigment black 7); tan (zinc ferrite). The DE value was recorded using an ACS Spectro-Sensor II spectrophotometer using large area view. Color differential (DE) is a comparison in color space defined by the measurement system (C.I.E. L*a*b*) developed by the International Commission on Illumination. The color differential refers to pigmented versus nonpigmented fibers. curves of the fibers were measured. The CIE color coordinates for each sample were calculated along with the color differences of each sample from a white standard under illuminant D65 using $$\Delta E_{ab}^{8}=[{}^{*}\Delta L^{*})^2+(\Delta a^{*})^2+(\Delta b^{*})^2]^{\frac{1}{2}}$$

the CIE 1976 L*a*b*(CIELAB) color difference equation.

The values for the equation are as follows:

$$L^{*}=116(Y/Y_n)^{\frac{1}{3}}-16$$

$$a^{*}=500[(X/X_n)^{\frac{1}{3}}-(Y/Y_n)^{\frac{1}{3}}]$$

$$b^{*}=200[(Y/Y_n)^{\frac{1}{3}}-(Z/Z_n)^{\frac{1}{3}}]$$

Here $X_n$, $Y_n$, and $Z_n$ are the tristimulus values of the reference white. For values of $X/X_n$, $Y/Y_n$, or $Z/Z_n$ less than 0.01:

$$L^{*}=116\left[f\left(\frac{Y}{Y_n}\right)-\frac{16}{116}\right]$$

$$a^{*}=500\left[f\left(\frac{X}{X_n}\right)-f\left(\frac{Y}{Y_n}\right)\right]$$

$$b^{*}=200\left[f\left(\frac{Y}{Y_n}\right)-f\left(\frac{Z}{Z_n}\right)\right]$$

where $f(Y/Y_n)=(Y/Y_n)^{\frac{1}{3}}$ for $Y/Y_n$ greater than 0.008856 and $f(Y/Y_n)=7.787(Y/Y_n)+16/116$ for $Y/Y_n$ less than or equal to 0.008856; $f(X/X_n)$ and $f(Z/Z_n)$ are similarly defined.

The reverse transformation (for $Y/Y_n > 0.008856$) is $$X = X_n\left(\frac{L^* + 16}{116} + \frac{a^*}{500}\right)^3$$

$$Y = Y_n\left(\frac{L^* + 16}{116}\right)^3$$

$$Z = Z_n\left(\frac{L^* + 16}{116} - \frac{b^*}{200}\right)^3$$

TABLE I

| Pigment Color | % Pigment Loading | DE Value |
|---|---|---|
| 1) Phthalo Blue | 0.0020 | 11.4 |
| 2) Carbon Black | 0.0033 | 15.4 |
| 3) Carbon Black | 0.0025 | 11.2 |
| 4) Zinc Ferrite | 0.0270 | 11.1 |
| 5) Phthalo Blue | 0.0030 | 15.3 |

The polymers were then spun into fiber and thereafter tufted into a carpet in greige form. A control carpet was made from fibers having no tint. Both carpets were acid dyed in shades that are commonly found in deep dye components. The color difference (DE) between the pigmented carpet and natural untinted control is set forth in Table II.

TABLE II

| | Overdye Color (DE) | | | | |
|---|---|---|---|---|---|
| Pigment | Red | Gray | Blue | Brown | Average |
| 1) Phthalo Blue | 0.2 | 1.9 | 0.3 | 1.2 | 0.9 |
| 2) Carbon Black | 1.3 | 2.2 | 2.3 | 1.0 | 1.7 |
| 3) Carbon Black | — | — | — | — | — |
| 4) Zinc Ferrite | 1.4 | 2.5 | 1.7 | 1.0 | 1.7 |
| 5) Phthalo Blue | — | — | — | — | — |

The overdyed carpets were then exposed to 100 hours xenon lamp exposure and measured again for color difference. The results are reported in Table III. A control section lacking the xenon lamp exposure was also measured.

TABLE III

| | Overdye Color After Exposure (DE) | | | | |
|---|---|---|---|---|---|
| Pigment | Red | Gray | Blue | Brown | Average |
| 1) Phthalo Blue | 3.1 | 4.2 | 5.8 | 3.6 | 4.2 |
| 2) Carbon Black | 3.7 | 2.7 | 5.0 | 2.7 | 3.5 |
| 3) Carbon Black | — | — | — | — | — |
| 4) Zinc Ferrite | 4.4 | 4.2 | 5.0 | 3.2 | 4.2 |
| 5) Phthalo Blue | — | — | — | — | — |
| 6) Non-Pigmented Control | 1.5 | 2.5 | 5.5 | 4.2 | 3.4 |

Samples of the yarns were visually evaluated during the tufting process. Phthalo blue 1) had marginal visibility; phthalo blue 5) had sufficient pigment loading to be detectable in process. Neither the carbon black sample nor the zinc ferrite tan sample could be detected visually in process. Since the DE levels were comparable, this indicates that background plays an important part in color perception. At the same loading level, phthalo blue was more visible and is the preferred pigment. Other pigment colors that may be satisfactory include emerald green, orange, crimson.

EXAMPLE II

This example shows the effect of blending a conventional pigmented fiber with non-pigmented natural fibers to obtain a level of color identifiable in processing. A nylon 6 polymer containing phthalo blue pigment was formed into a carpet fiber, blended with non-pigmented fibers, carded and pin drafted. The resultant yarns were formed into knit tubes and DE values measured.

TABLE IV

| % Identifier | DE |
|---|---|
| 0.5 | 4.5 |
| 1.0 | 7.1 |
| 3.0 | 15.3 |
| 5.0 | 18.1 |
| 10.0 | 23.9 |

The data reflected in Table IV indicates that a 3% level of phthalo Blue pigmented fiber results in a blend equal to Blue 5) in Example I.

Thus, it can be seen that a permanently tinted polymer, preferably phthalo blue, yields a good identifier for processing. Its use in a deep dye fiber with other dye variants is indicative of its flexibility and diversity in overdyes of variant dyeing polymeric fibers.

What is claimed is:

1. A method of distinguishing between two or more polyamide fibers in greige fabric, said fibers having different dye affinities, comprising the steps of adding sufficient pigment to one fiber during fiber forming to make it visible to the eye, and leaving one unpigmented fiber.

2. The method of claim 1 wherein the pigmented fiber has greater dye affinity than the unpigmented fiber.

3. The method of claim 1 wherein the pigmented fiber has a greater acid dye affinity than the unpigmented fiber.

4. The method of claim 3 wherein the pigmented fiber is a polyamide having an amide end group content of greater than about 60 meq/kg.

5. The method of claim 4 wherein the pigmented fiber has a Color Differential (DE) of about 14±3 from the unpigmented fiber.

6. The method of claim 5 wherein the unpigmented fiber is a polyamide having functional end groups reactable with cationic dyes.

7. The method of claim 1 wherein at least a third polyamide fiber is oversprayed with a fugitive tint of a color different from the pigmented fiber.

8. A method according to claim 1 comprising adding to the polymer melt of a fiber forming polymer a pigment in the concentration range of between about 0.0020 and 0.0030 weight percent.

9. A method according to claim 8 wherein the pigment is C.I. Pigment Blue 15.

10. A method according to claim 8 wherein the polymer is a nylon having deep dye affinity.

* * * * *

UNITED STATES PATENT AND TRADEMARK OFFICE

CERTIFICATE OF CORRECTION

PATENT NO. : 5,066,308

DATED : November 19, 1991

INVENTOR(S) : Ling Yeh, Hugh G. Harrelson and Andrew M. Coons, III

It is certified that error appears in the above-identified patent and that said Letters Patent is hereby corrected as shown below:

Column 2, line 36, add --Reflectance- before "curves".

At column 2, line 41, please delete "8" and substitute --*-- in its place.

Signed and Sealed this

Ninth Day of March, 1993

*Attest:*

STEPHEN G. KUNIN

*Attesting Officer*

*Acting Commissioner of Patents and Trademarks*